US006263767B1

(12) United States Patent
Hu

(10) Patent No.: US 6,263,767 B1
(45) Date of Patent: Jul. 24, 2001

(54) PAWL FOR A RATCHET-TYPE SPANNER

(75) Inventor: Bobby Hu, Taipei (TW)

(73) Assignee: Hi-Five Products Developing Co., Ltd., Taichung (TW)

( * ) Notice: Subject to any disclaimer, the term of this patent is extended or adjusted under 35 U.S.C. 154(b) by 0 days.

(21) Appl. No.: 09/523,624

(22) Filed: Mar. 13, 2000

(30) Foreign Application Priority Data

Jan. 19, 2000 (TW) ..... 89201043 U

(51) Int. Cl.[7] ..... B25B 13/46
(52) U.S. Cl. ..... 81/60; 81/58
(58) Field of Search ..... 81/58, 58.4, 59.1, 81/60, 63.1, 63.2

(56) References Cited

U.S. PATENT DOCUMENTS

D. 433,896 11/2000 Wei .
4,308,768 * 1/1982 Wagner ..... 81/60
4,991,468 * 2/1991 Lee ..... 81/60
5,230,262 * 7/1993 Ahlund et al. ..... 81/63.2
5,392,672 * 2/1995 Larson et al. ..... 81/60
5,636,557 * 6/1997 Ma ..... 81/60
5,964,129 * 10/1999 Shiao ..... 81/63.2

* cited by examiner

*Primary Examiner*—Joseph J. Hail, III
*Assistant Examiner*—David B. Thomas
(74) *Attorney, Agent, or Firm*—Alan Kamrath; Rider, Bennett, Egan & Arundel, LLP

(57) ABSTRACT

A ratchet-type spanner includes a handle and a box end extended from the handle and having a hole. A slant hole is defined in a web between the handle and the box end and communicated with the hole of the box end. A ratchet gear includes an inner periphery for driving a fastener. The ratchet gear is rotatably mounted in the hole of the box end. A pawl is mounted in the slant hole and includes a first end with teeth for releasably engaging with teeth of the ratchet gear. A plug is securely mounted in the slant hole by force-fitting engagement with an inner periphery defining the slant hole. An elastic member is mounted in the slant hole and has a first end attached to the second end of the pawl and a second end attached to the plug for biasing the pawl to engage with the ratchet gear. The first end of the pawl includes a beveled face that faces the inner periphery of the slant hole.

19 Claims, 8 Drawing Sheets

PAWL FOR A RATCHET-TYPE SPANNER

BACKGROUND OF THE INVENTION

1. Field of the Invention

The present invention relates to a pawl for a ratchet-type spanner to provide reliable ratcheting.

2. Description of the Related Art

Spanners are the best choice for working in a tight area, yet the backlash is too large. Ratchet-type spanners have been proposed to solve this problem, and FIGS. 7 through 9 of the drawings illustrate a typical design. As illustrated in FIG. 7, the ratchet-type spanner includes a handle 1' with a box end 11' for rotatably receiving a ratchet gear 2' that is mounted between a ring-like cover plate 6' and a ledge 8' and retained in place by a C-clip 7'. A side of the box end 11' is drilled to form a hole 12' that extends along an axis at an angle of θ (12°~18°) with a horizontal axis of the box end 11'. A pawl 3' is mounted in the hole 12' and includes ratchet teeth 31' formed on a side thereof for releasably engaging with teeth 21' of the ratchet gear 2' and a includes compartment 32' defined in the other side thereof. A spring 4' is mounted in the compartment 32' for biasing the pawl 3' to engage with the teeth 21'. A threaded plug 5' is mounted in the hole 12' and engaged with an inner threading 121' of the hole 12'. The plug 5' includes an inner side 51' for retaining the spring 4' and the pawl 3' in place and includes an outer side with a hexagonal recess 52'.

Nevertheless, the position of the plug 5' affects the function of the pawl 3'. Namely, the pawl 3' cannot be effectively engaged with the ratchet gear 2' for ratcheting if the plug 5' is too far from the ratchet gear 2'. On the other hand, the pawl 3' will be stuck with the ratchet gear 2' if the plug 5' is too close to the ratchet gear 2'. Optimal positioning of the plug 5' is time-consuming and very difficult to achieve even by a skilled worker. Assembly cost is accordingly increased. In addition, the threading engagement between the plug 5' and the hole 12' tends to wear after a term of use such that the user often has to bond the plug by adhesive or glue. Use of the spanner becomes more inconvenient. In addition, assembly of the spanner is complicated and expensive, as the cover 6' and C-clip 7' are required. Furthermore, formation of the ledge 8' requires expensive and accurate computer-numeric-control (CNC), which further results in an increase in the cost.

The present invention is intended to provide a pawl for a ratchet-type spanner that mitigates and/or obviates the above problems.

SUMMARY OF THE INVENTION

In accordance with a first aspect of the invention, a ratchet-type spanner comprises:

a handle;

a box end extended from the handle and having a hole, a slant hole being defined in a web between the handle and the box end and communicated with the hole of the box end;

a ratchet gear including an inner periphery adapted to drive a fastener and an outer periphery, the outer periphery of the ratchet gear including a plurality of first teeth, the ratchet gear being rotatably mounted in the hole of the box end;

a pawl mounted in the slant hole and including a first end with a plurality of second teeth for releasably engaging with the first teeth of the ratchet gear, the pawl further including a second end;

a plug securely mounted in the slant hole by force-fitting engagement with an inner periphery defining the slant hole; and an elastic member mounted in the slant hole and having a first end attached to the second end of the pawl and a second end attached to the plug for biasing the second teeth of the pawl to engage with the first teeth of the ratchet gear.

The first end of the pawl includes a beveled face that faces the inner periphery of the slant hole. The web includes an inclined indication area for indicating ratcheting direction of the ratchet-type spanner by an inclination direction of the inclined indication area. The plug includes at least one knurl formed on an outer periphery thereof, the knurl being in force-fitting engagement with the inner periphery defining the slant hole. An inner periphery defining the hole of the box end includes a first annular groove. The outer periphery of the ratchet gear includes a second annular groove facing the first annular groove. A C-clip is received in the first annular groove and the second annular groove for rotatably retaining the ratchet gear in the hole of the box end.

In accordance with a second aspect of the invention, a ratchet-type spanner comprises:

a handle;

a box end extended from the handle and having a hole, a slant hole being defined in a web between the handle and the box end and communicated with the hole of the box end, the web including an inclined indication area for indicating ratcheting direction of the ratchet-type spanner by an inclination direction of the inclined indication area;

a ratchet gear including an inner periphery adapted to drive a fastener and an outer periphery, the outer periphery of the ratchet gear including a plurality of first teeth, the ratchet gear being rotatably mounted in the hole of the box end;

a pawl mounted in the slant hole and including a first end with a plurality of second teeth for releasably engaging with the first teeth of the ratchet gear, the pawl further including a second end;

a plug securely mounted in the slant hole; and an elastic member mounted in the slant hole and having a first end attached to the second end of the pawl and a second end attached to the plug for biasing the second teeth of the pawl to engage with the first teeth of the ratchet gear.

In accordance with a third aspect of the invention, a ratchet-type spanner comprises:

a handle;

a box end extended from the handle and having a hole, a slant hole being defined in a web between the handle and the box end and communicated with the hole of the box end;

a ratchet gear including an inner periphery adapted to drive a fastener and an outer periphery, the outer periphery of the ratchet gear including a plurality of first teeth, the ratchet gear being rotatably mounted in the hole of the box end;

a pawl mounted in the slant hole and including a first end with a plurality of second teeth for releasably engaging with the first teeth of the ratchet gear, the pawl further including a second end;

a plug securely mounted in the slant hole; and an elastic member mounted in the slant hole and having a first end attached to the second end of the pawl and a second end attached to the plug for biasing the second teeth of the pawl to engage with the first teeth of the ratchet gear;

the first end of the pawl further including a beveled face that faces the inner periphery of the slant hole and the pawl bears against the inner periphery of the slant hole at a point, whereby when the ratchet-type spanner is turned, the beveled face of the pawl is capable of pivoting about the point and thus moving toward the inner periphery of the slant hole, thereby assuring reliable engagement between the first teeth of the ratchet gear and the second teeth of the pawl.

In accordance with a fourth aspect of the invention, a ratchet-type spanner comprises:

a handle;

a box end extended from the handle and having a hole, an inner periphery defining the hole of the box end including a first annular groove, a slant hole being defined in a web between the handle and the box end and communicated with the hole of the box end;

a ratchet gear including an inner periphery adapted to drive a fastener and an outer periphery, the outer periphery of the ratchet gear including a plurality of first teeth, the ratchet gear being rotatably mounted in the hole of the box end, the outer periphery of the ratchet gear further including a second annular groove facing the first annular groove;

a C-clip received in the first annular groove and the second annular groove for rotatably retaining the ratchet gear in the hole of the box end;

a pawl mounted in the slant hole and including a first end with a plurality of second teeth for releasably engaging with the first teeth of the ratchet gear, the pawl further including a second end;

a plug securely mounted in the slant hole; and an elastic member mounted in the slant hole and having a first end attached to the second end of the pawl and a second end attached to the plug for biasing the second teeth of the pawl to engage with the first teeth of the ratchet gear;

the first end of the pawl further including a beveled face that faces the inner periphery of the slant hole and the pawl bears against the inner periphery of the slant hole at a point, whereby when the ratchet-type spanner is turned, the beveled face of the pawl is capable of pivoting about the point and thus moving toward the inner periphery of the slant hole, thereby assuring reliable engagement between the first teeth of the ratchet gear and the second teeth of the pawl.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
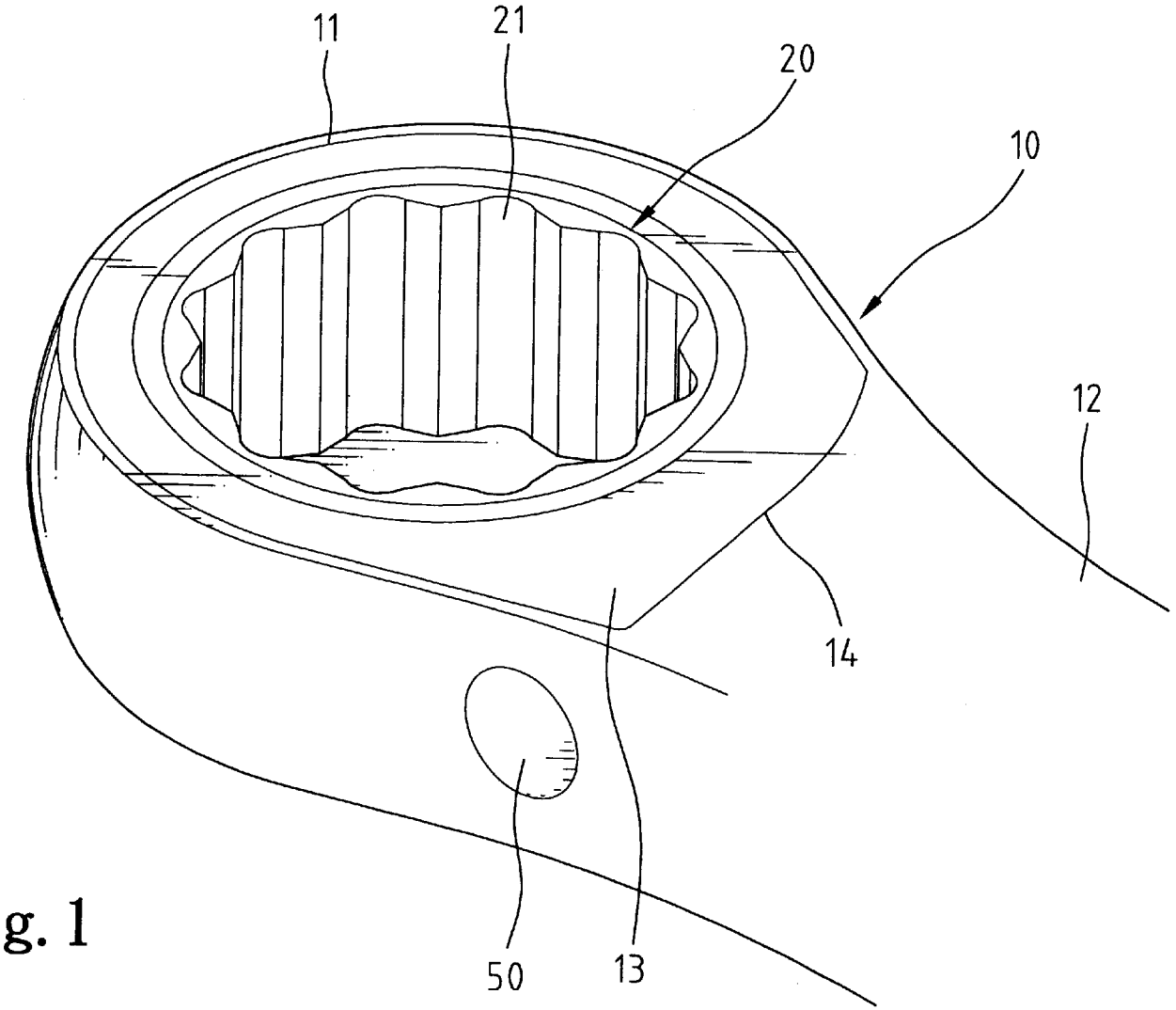
FIG. 1 is a perspective view of a perspective view of an end portion of a ratchet-type spanner in accordance with the present invention.
Figure 2:
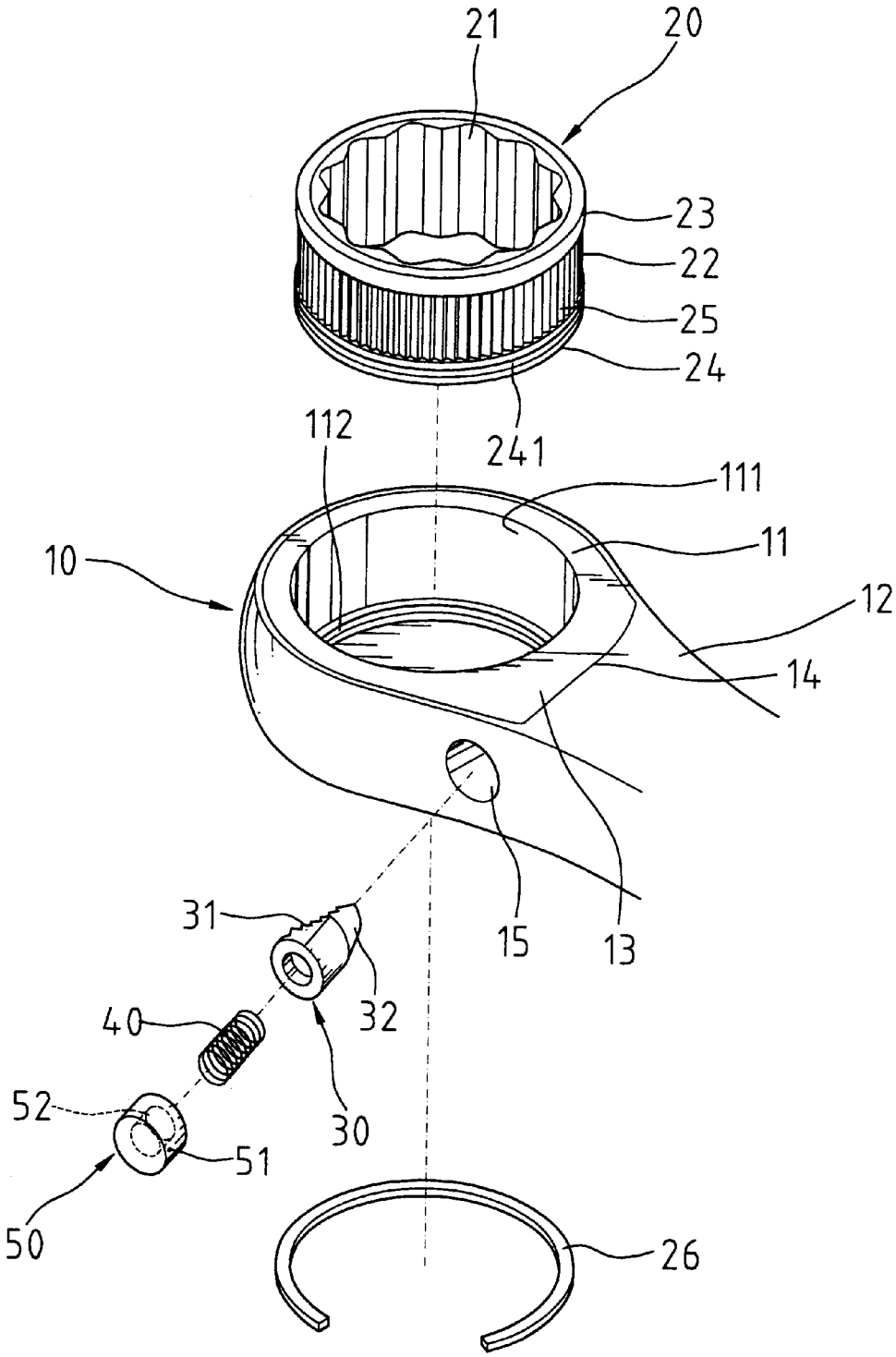
FIG. 2 is an exploded perspective view of the end portion of the ratchet-type spanner in accordance with the present invention.
Figure 3:
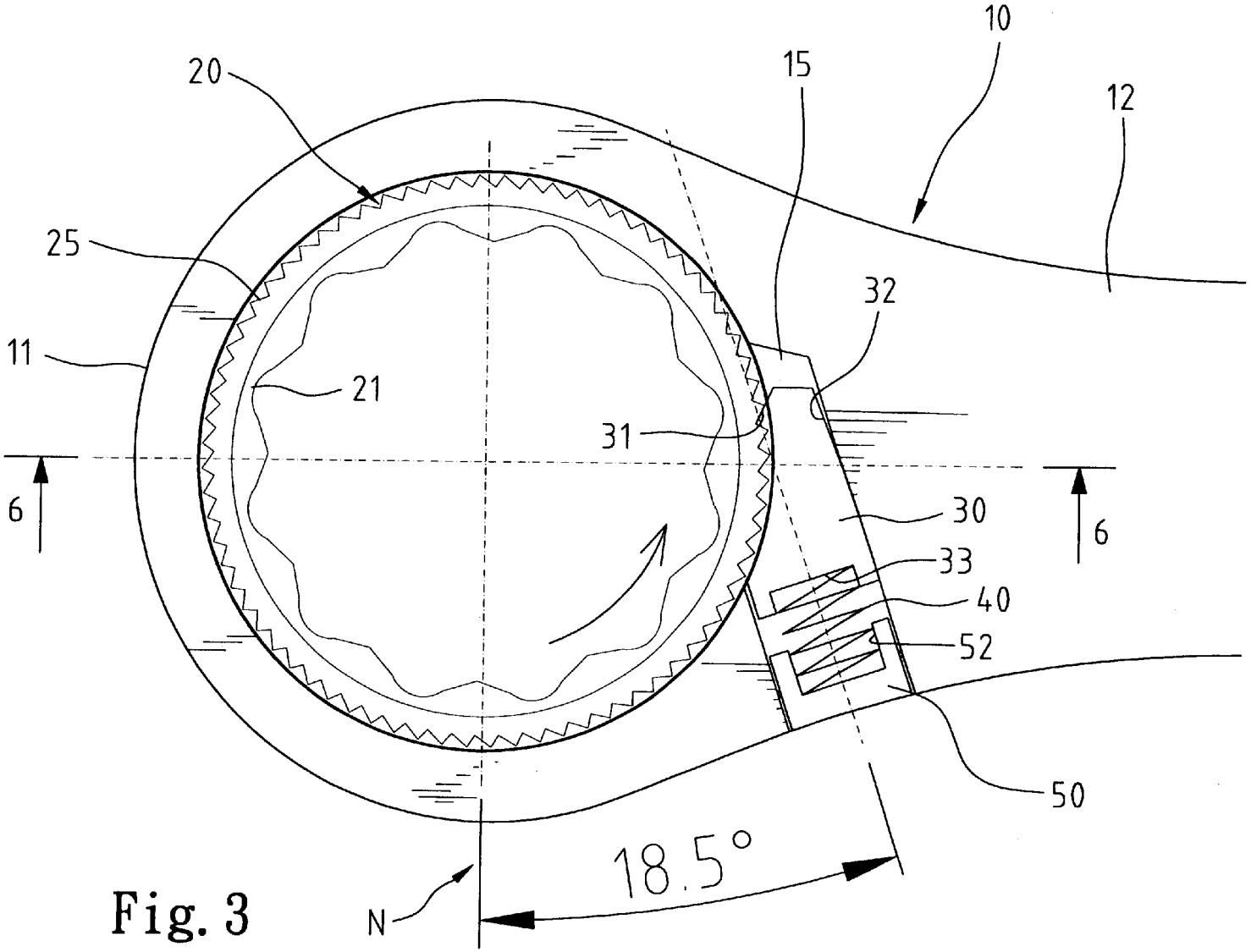
FIG. 3 is a top view, partly sectioned, of the end portion of the ratchet-type spanner in accordance with the present invention.

Referring to FIGS. 1 through 5 and initially to FIGS. 1 and 2, a ratchet-type spanner 10 in accordance with the present invention generally includes a handle 12 and a box end 11 having a hole 111. An inner periphery (not labeled) defining the hole 111 of the box end 11 includes an annular groove 112 in a lower portion thereof. The annular groove 12 is formed simultaneously when the hole 111 of the box end 11 is formed by a cutting tool. Thus, the manufacture cost for the spanner is reduced, as the annular ledge 8' and cover 6' required in the prior art ratchet-type spanner is omitted. A web 13 is defined between the box end 11 and the handle 12 and has an inclined indication area 14 for indicating ratcheting direction of the spanner by the inclination direction of the inclined indication area 14. A slant hole 15 is defined in the web 13 and includes an inner end communicated with the hole 111 of the box end 11 and an outer end communicated with outside. The slant hole 15 extends along an axis that is at an angle (preferably 18.5°) with a normal to a longitudinal axis of the box end, as shown in FIG. 3.

Figure 6:
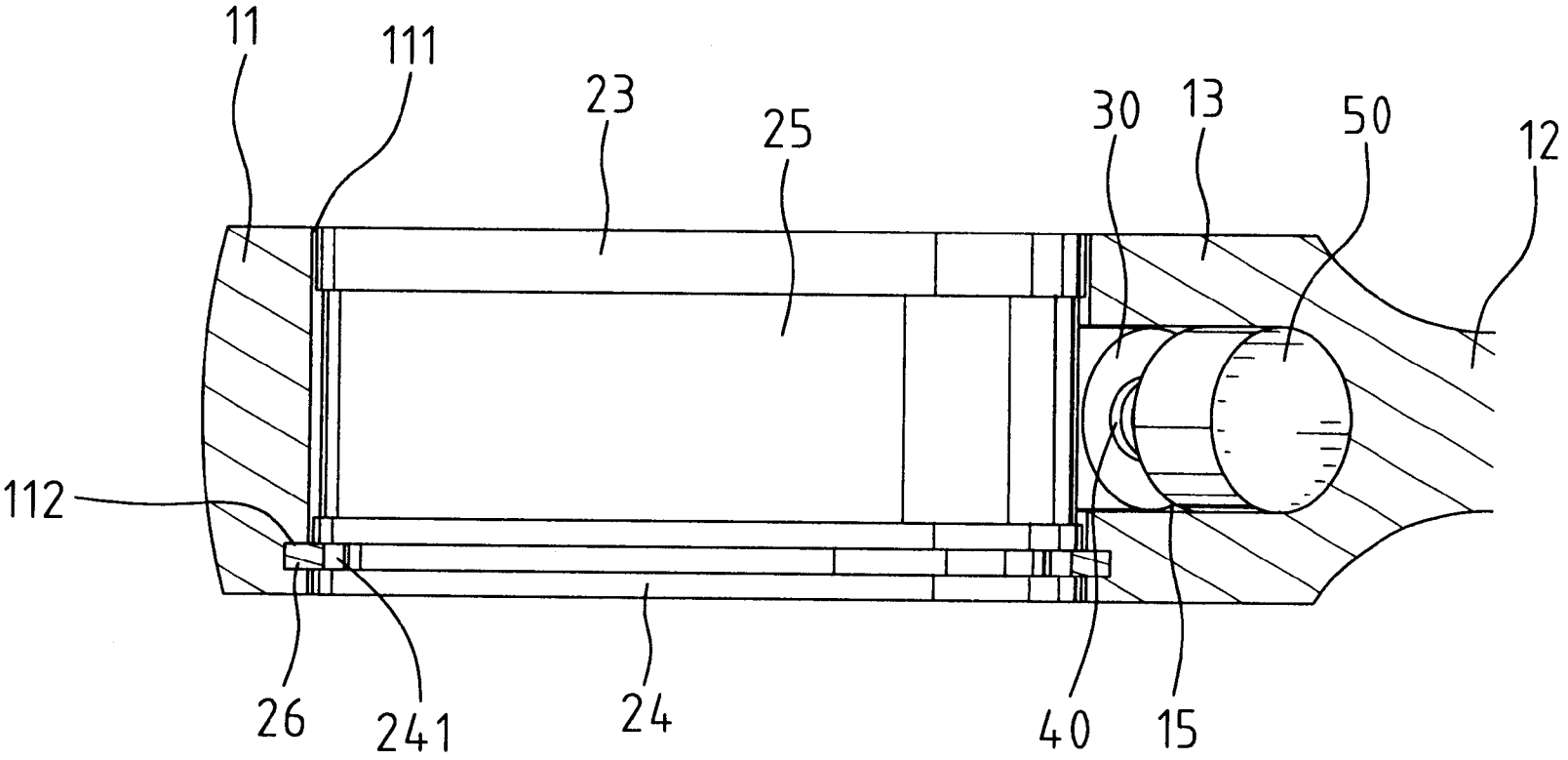
FIG. 6 is a sectional view taken along line 6—6 in FIG. 3.
Figure 7:
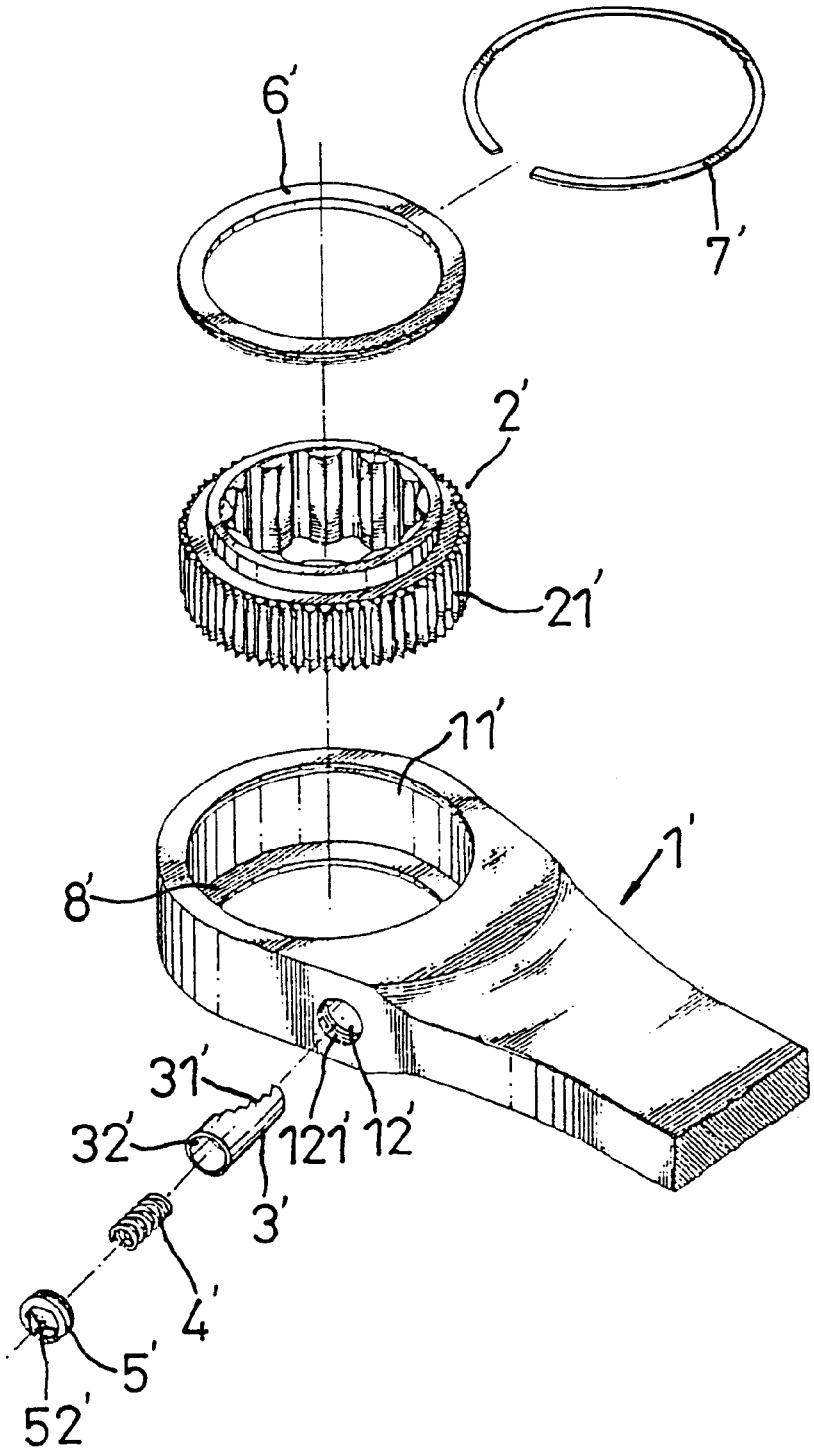
Fig. 7 PRIOR ART
FIG. 7 is an exploded perspective view of a ratchet-type spanner.
Figure 8:
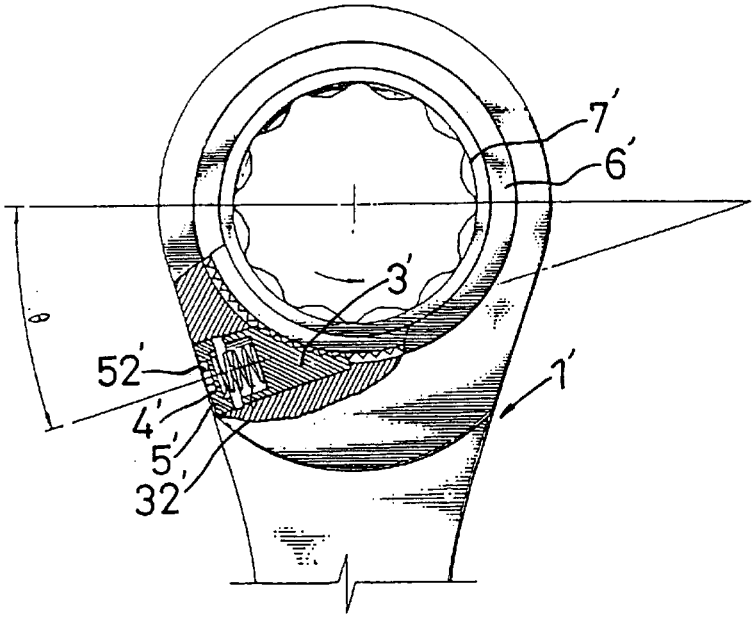
Fig. 8 PRIOR ART
FIG. 8 is a top view of an end portion of the ratchet-type spanner in FIG. 7.
Figure 9:
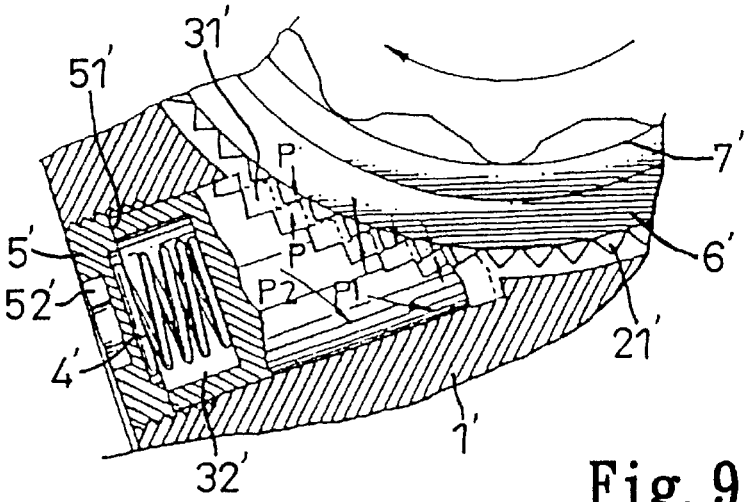
Fig. 9 PRIOR ART
FIG. 9 is an enlarged view of a portion of the end portion in FIG. 8.

A ratchet gear 20 is mounted in the box end 11 and includes an inner periphery 21 for driving a fastener (not shown) and an outer periphery 22. The outer periphery 22 includes an upper end portion 23, a lower end portion 24, and a middle portion with a plurality of recessed ratchet teeth 25. The lower end portion 24 includes an annular groove 241. A C-clip 26 is received in the annular groove 241 of the lower end portion 24 and the annular groove 112 of the box end 11, thereby rotatably retaining the ratchet gear 20 in the box end 11 of the spanner 10, best shown in FIG. 6.

A substantially cylindrical pawl 30 is mounted in the slant hole 15 in the web 13 and includes ratchet teeth 31 on an end thereof for engaging with ratchet teeth 25 of the ratchet gear 20. The end of the ratchet 31 further includes a beveled face 32, which will be described later. An elastic member 40 is also mounted in the slant hole 15 in the web 13 and includes an end attached to the other end of the pawl 30. The other end of the elastic member 40 is attached to a plug 50 that is securely mounted in the outer end of the hole 15 in the web 13. In this embodiment, the other side of the pawl 30 has a recess 33 (FIG. 3) for receiving the end of the elastic member 40 and the plug 50 includes a receptacle 52 in an inner side thereof for receiving the other end of the elastic member 40. The plug 50 includes at least one knurl 51 formed on an outer periphery thereof for retaining the plug 50 in place by force-fitting engagement with an inner periphery of the slant hole 15 in the web 13. Any tolerance problem in the diameter of the slant hole 15 and the outer diameter of the plug 50 is eliminated by the force-fitting engagement between the knurl 51 and the inner periphery of the hole 15.

Referring to FIG. 3, when not in use, the pawl 30 bears against the slant hole 15 at point A, and the beveled face 32 of the pawl 30 and the inner periphery of the slant hole 15 has a gap therebetween. The ratchet teeth 31 on the pawl 30 completely mesh with the concave ratchet teeth 25 of the ratchet gear 20. It is noted that the complete engagement between the 11 teeth 31 and 25 occurs when the slant hole 15 extends along an axis that is at an angle of 18.5° with the normal to the longitudinal axis of the box end 11.

Figure 4:
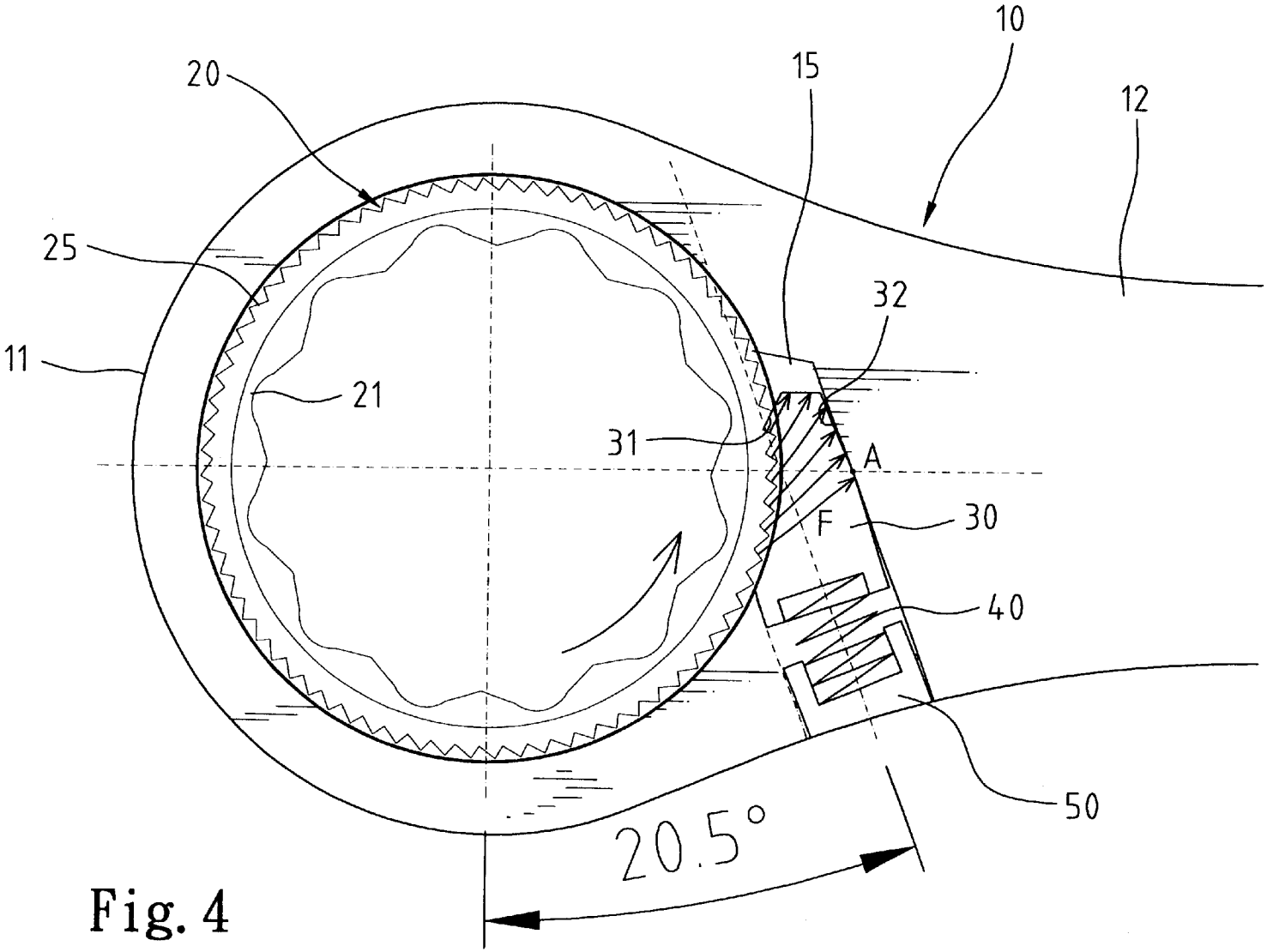
FIG. 4 is a view similar to FIG. 3, wherein a hole in a web in the spanner extends along a different axis.

Turning to FIG. 4, in some cases the slant hole 15 does not extend along an axis that is at an angle of 18.5° with the normal to the longitudinal axis of the box end 11 due to tolerance in the processing precision. For example, when the slant hole 15 extends along an axis that is at an angle of 20.5° with the normal to the longitudinal axis of the box end 11, the beveled face 32 of the pawl 30 and the inner periphery of the hole 15 has a gap therebetween. When the spanner 10 is turned, the ratchet teeth 31 on the pawl 30 are subjected to a force F via transmission of the ratchet teeth 25 of the ratchet gear 20. The pawl 30 pivots about point A such that the beveled face 32 of the pawl 30 is in intimate contact with the inner periphery of the hole 15, thereby still providing complete engagement between the teeth 31 and 25.

Figure 5:
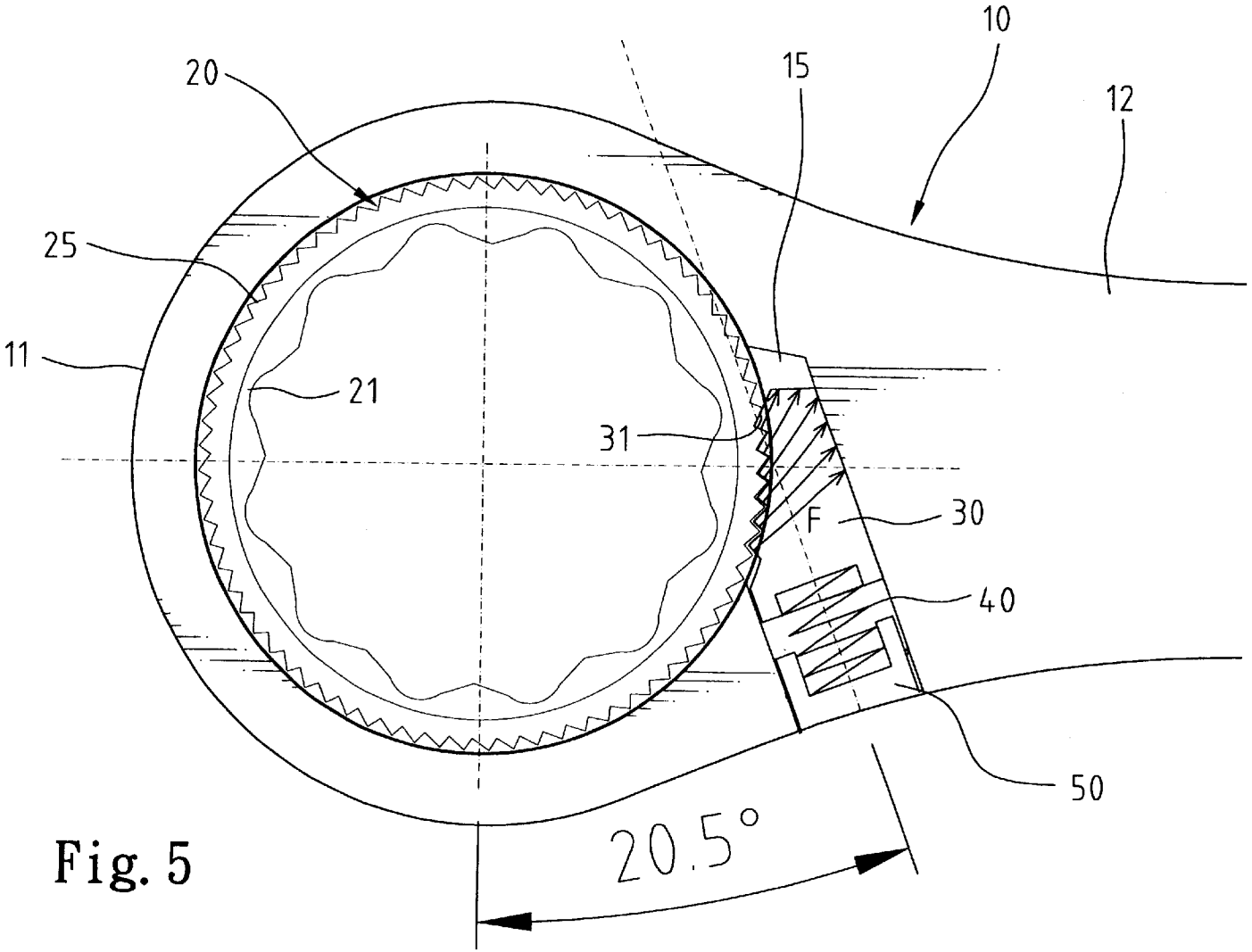
FIG. 5 is a view similar to FIG. 3, wherein the pawl has no beveled face.

FIG. 5 illustrates a comparative example, wherein the pawl 30 has no beveled face 32 while the slant hole 15 extends along an axis that is at an angle of 20.520 with the normal to the longitudinal axis of the box end 11. It is apparent that the ratchet teeth 31 on the pawl 30 cannot engage with the ratchet teeth 25 of the ratchet gear 20 without provision of the beveled face 32 when the spanner 10 is turned. Thus, provision of the beveled face 32 on the pawl 30 may obviate manufacture tolerance of drilling the slant hole 15 in the web 13.

According to the above description, it is appreciated that the ratchet-type spanner in accordance with the present invention includes several advantages. Firstly, the inclined indication area 14 indicates the ratcheting direction of the spanner. Manufacture of the box end 11 is easier and inexpensive by means of directly forming the annular grooves 112 and 241, and the assembly procedure is easier, as the cover 6' and ledge 8' in the conventional design is not required. In addition, the knurl 51 of the plug 50 may reliably retain the plug 50 in place and thus retain the pawl 30 and the elastic member 40 in place, and the tolerance problem is also obviated. Furthermore, the beveled face 32 of the pawl 30 may obviate manufacture tolerance of drilling the slant hole 15 in the web 13.

Although the invention has been explained in relation to its preferred embodiment, it is to be understood that many other possible modifications and variations can be made without departing from the spirit and scope of the invention as hereinafter claimed.

What is claimed is:

1. A ratchet-type spanner, comprising:

a handle;

a box end extended from the handle and having a hole, a slant hole being defined in a web between the handle and the box end and communicated with the hole of the box end;

a ratchet gear including an inner periphery adapted to drive a fastener and an outer periphery, the outer periphery of the ratchet gear including a plurality of first teeth, the ratchet gear being rotatably mounted in the hole of the box end;

a pawl mounted in the slant hole and including a first end with a plurality of second teeth for releasably engaging with the first teeth of the ratchet gear, the pawl further including a second end;

a plug securely mounted in the slant hole, wherein the plug includes at least one knurl formed on an outer periphery thereof, said at least one knurl being in force-fitting engagement with an inner periphery defining the slant hole; and an elastic member mounted in the slant hole and having a first end attached to the second end of the pawl and a second end attached to the plug for biasing the second teeth of the pawl to engage with the first teeth of the ratchet gear.

2. The ratchet-type spanner as claimed in claim 1, wherein the first end of the pawl includes a beveled face that faces the inner periphery of the slant hole and a point of the beveled face of the pawl bears against the inner periphery of the slant hole, whereby when the ratchet-type spanner is turned, the beveled face of the pawl is capable of pivoting about the point and thus moving toward the inner periphery of the slant hole, thereby assuring reliable engagement between the first teeth of the ratchet gear and the second teeth of the pawl.

3. The ratchet-type spanner as claimed in claim 1, wherein the web includes an inclined indication area for indicating ratcheting direction of the ratchet-type spanner by an inclination direction of the inclined indication area.

4. The ratchet-type spanner as claimed in claim 1, wherein an inner periphery defining the hole of the box end includes a first annular groove, the outer periphery of the ratchet gear including a second annular groove facing the first annular groove, further comprising a C-clip received in the first annular groove and the second annular groove for rotatably retaining the ratchet gear in the hole of the box end.

5. A ratchet-type spanner, comprising:

a handle;

a box end extended from the handle and having a hole, a slant hole being defined in a web between the handle and the box end and communicated with the hole of the box end, the web including an inclined indication area for indicating ratcheting direction of the ratchet-type spanner by an inclination direction of the inclined indication area;

a ratchet gear including an inner periphery adapted to drive a fastener and an outer periphery, the outer periphery of the ratchet gear including a plurality of first teeth, the ratchet gear being rotatably mounted in the hole of the box end;

a pawl mounted in the slant hole and including a first end with a plurality of second teeth for releasably engaging with the first teeth of the ratchet gear, the pawl further including a second end; and an elastic member mounted in the slant hole for biasing the second teeth of the pawl to engage with the first teeth of the ratchet gear.

6. The ratchet-type spanner as claimed in claim 5, wherein the first end of the pawl includes a beveled face that faces the inner periphery of the slant hole and a point of the beveled face of the pawl bears against the inner periphery of the slant hole, whereby when the ratchet-type spanner is turned, the beveled face of the pawl is capable of pivoting about the point and thus moving toward the inner periphery of the slant hole, thereby assuring reliable engagement between the first teeth of the ratchet gear and the second teeth of the pawl.

7. The ratchet-type spanner as claimed in claim 5, wherein the plug includes at least one knurl formed on an outer periphery thereof, said at least one knurl being in force-fitting engagement with an inner periphery defining the slant hole.

8. The ratchet-type spanner as claimed in claim 5, wherein an inner periphery defining the hole of the box end includes a first annular groove, the outer periphery of the ratchet gear including a second annular groove facing the first annular groove, further comprising a C-clip received in the first annular groove and the second annular groove for rotatably retaining the ratchet gear in the hole of the box end.

9. The ratchet-type spanner as claimed in claim 5, further comprising:

a plug securely mounted in the slant hole, wherein the elastic member has a first end attached to the second end of the pawl and a second end attached to the plug.

10. The ratchet-type spanner as claimed in claim 9, wherein the plug includes at least one knurl formed on an outer periphery thereof, said at least one knurl being in force-fitting engagement with an inner periphery defining the slant hole.

11. The ratchet-type spanner as claimed in claim 9, wherein an inner periphery defining the hole of the box end includes a first annular groove, the outer periphery of the ratchet gear including a second annular groove facing the first annular groove, further comprising a C-clip received in the first annular groove and the second annular groove for rotatably retaining the ratchet gear in the hole of the box end.

12. The ratchet-type spanner as claimed in claim ?15, further comprising:

a plug securely mounted in the slant hole, wherein the elastic member has a first end attached to the second end of the pawl and a second end attached to the plug.

13. The ratchet-type spanner as claimed in claim 12, wherein the plug includes at least one knurl formed on an outer periphery thereof, said at least one knurl being in force-fitting engagement with an inner periphery defining the slant hole.

14. The ratchet-type spanner as claimed in claim 12, wherein an inner periphery defining the hole of the box end includes a first annular groove, the outer periphery of the ratchet gear including a second annular groove facing the first annular groove, further comprising a C-clip received in the first annular groove and the second annular groove for rotatably retaining the ratchet gear in the hole of the box end.

15. A ratchet-type spanner, comprising:

a handle;

a box end extended from the handle and having a hole, an inner periphery defining the hole of the box end including a first annular groove, a slant hole being defined in a web between the handle and the box end and communicated with the hole of the box end;

a ratchet gear including an inner periphery adapted to drive a fastener and an outer periphery, the outer periphery of the ratchet gear including a plurality of first teeth, the ratchet gear being rotatably mounted in the hole of the box end, the outer periphery of the ratchet gear further including a second annular groove facing the first annular groove;

a C-clip received in the first annular groove and the second annular groove for rotatably retaining the ratchet gear in the hole of the box end;

a pawl mounted in the slant hole and including a first end with a plurality of second teeth for releasably engaging with the first teeth of the ratchet gear, the pawl further including a second end; and an elastic member mounted in the slant hole for biasing the second teeth of the pawl to engage with the first teeth of the ratchet gear, thereby assuring reliable engagement between the first teeth of the ratchet gear and the second teeth of the pawl.

16. The ratchet-type spanner as claimed in claim 15, wherein the first end of the pawl includes a beveled face that faces the inner periphery of the slant hole, and a point of the beveled face of the pawl bears against the inner periphery of the slant hole, whereby when the ratchet-type spanner is turned, the beveled face of the pawl is capable of pivoting about the point and thus moving toward the inner periphery of the slant hole, thereby assuring reliable engagement between the first teeth of the ratchet gear and the second teeth of the pawl.

17. The ratchet-type spanner as claimed in claim 15, wherein the plug includes at least one knurl formed on an outer periphery thereof, said at least one knurl being in force-fitting engagement with an inner periphery defining the slant hole.

18. The ratchet-type spanner as claimed in claim 15, wherein the web includes an inclined indication area for indicating ratcheting direction of the ratchet-type spanner by an inclination direction of the inclined indication area.

19. The ratchet-type spanner as claimed in claim 15, wherein the first teeth of the ratchet gear are concave.

* * * * *